US005694648A

United States Patent [19]

Nucifora

[11] Patent Number: 5,694,648

[45] Date of Patent: Dec. 9, 1997

[54] CAP WITH POCKET FOR RECEIVING NECK SHIELD

[76] Inventor: Luigi Nucifora, No.25,Via degli Aldobrandini, 00121 Ostia - Roma, Italy

[21] Appl. No.: 304,861

[22] Filed: Sep. 13, 1994

[30] Foreign Application Priority Data

Sep. 20, 1993 [IT] Italy ..... RM930166 U

[51] Int. Cl.[6] ..... A42B 1/06

[52] U.S. Cl. ..... 2/172; 2/195.1; 2/209.13

[58] Field of Search ..... 2/172, 171, 175.1, 2/175.6, 195.1, 209.13

[56] References Cited

U.S. PATENT DOCUMENTS

| | | | |
|---|---|---|---|
| 1,179,473 | 4/1916 | Taylor | 2/172 |
| 1,690,736 | 11/1928 | Leicht | 2/172 |
| 2,192,341 | 3/1940 | Dahlberg | 2/172 |
| 2,743,454 | 5/1956 | Woodbury | 2/172 |
| 2,897,510 | 8/1959 | Forbes-Robinson | 2/172 |
| 4,980,928 | 1/1991 | Ellis | 2/175.1 |
| 5,153,943 | 10/1992 | Clement | 2/172 |
| 5,212,837 | 5/1993 | Gose et al. | 2/172 |

FOREIGN PATENT DOCUMENTS

| | | | |
|---|---|---|---|
| 825461 | 12/1951 | Germany | 2/209.13 |

*Primary Examiner*—Diana Biefeld
*Attorney, Agent, or Firm*—Barnes,Kisselle,Raisch,Choate,Whittemore & Hulbert, P.C.

[57] ABSTRACT

An integral peaked cap provided with accessory fittings for protection of neck, ears, face, replaceable into the cap itself, characterized in that the cap comprises a first accessory fitting for protection of neck and ears, provided with closure means in a position corresponding to the throat of the user, a second accessory fitting for protection of the face, in that said first and second accessory fittings are housed in first and second pockets provided in said peaked cap, in that said first and second pockets are provided with closure means.

5 Claims, 3 Drawing Sheets

CAP WITH POCKET FOR RECEIVING NECK SHIELD

This Utility Design Application relates to a peaked cap provided with protective accessory fittings for neck, ears and face, which, when they are not in use, can be replaced into the peaked cap itself.

More particularly, this Utility Design deals with a peaked cap of conventional kind, provided with protective accessory fittings for neck, ears and face, which can be quickly unfolded into operative position in view of the fact that , upon folding, they are housed in suitable housings provided in the cap itself, such cap being adapted to be used in a large number of sporting, recreative and operative activities, during which the user is exposed to hindrances of various atmospheric events, such as sunshine, rain, dust, polluting substances, wind and like, As a matter of fact, it is known that both for sporting and for recreative outdoor activities of various kinds, caps of various types have been designed in order to protect the head and the face of the user by means of a peak.

The protection of the neck, of the nape of the neck, of the ears, as well as of the front portion of the neck, corresponding to the throat has been generally entrusted to devices of provisional and occasional character, such as neckerchiefs to be wound around the neck itself, or scarves and mufflers depending from the cap and held by itself.

The protection of the face, in addition, is entrusted to devices of various kinds, such as masks and glasses, possibly attached to the ears.

Furthermore, glasses of suitable type should always be provided for protection of the eyes and, in the first place while sporting or particularly dynamic activities are being carried out, such necessary glasses should be anyway connected to the cap in order to prevent them to drop away or to be removed.

It is quite apparent, therefore, that, at the present state of the art, when an effective protection of all portions of the head is desired, the user is obliged to be provided with many different and separate elements and they should be all connected together, so as to guarantee an effective protection when they are in use.

It is also apparent that, when the user has no need to use any one of the concerned accessory fittings, he meets the problem to fold and to replace it into pockets of his garments or like, with the foreseeable consequences that such item will uselessly occupy housings intended for other uses and where it can be easily forgotten. In this case, should it be needed in subsequent circumstances, it will not be immediately available.

It is apparent, therefore, that the necessity exists to provide a cap capable to eliminate all of the above mentioned disadvantages and adapted to consistently offer protection of neck, ears, throat and face, thereby enabling the user to rapidly exploit its various sections during the execution of his various activities.

In order to fulfil such requirements, according to this Utility Model, it is proposed to create a peaked cap provided with protective elements for neck, ears and face, with fastening elements for glasses, of selective type depending on the working needs and replaceable into suitable pockets provided in said cap, when they are not to be used, so as to enable the user to protect the various portion of his head according to the needs and to the activity type which is being carded out, thereby enabling also to rapidly replace said same accessory fittings into the cap itself, when such elements are not needed, thereby eliminating the necessity to look for alternative housings for them.

It is specific subject-matter of this Utility Model, therefore, a peaked cap provided with accessory fittings for protection of neck, ears, face, replaceable into the cap itself, characterized in that the cap comprises a first accessory fitting for protection of neck and ears, provided with closure means in corresponding position to the throat of the user, a second accessory fitting for protection of the face, in that said first and second accessory fittings are housed in first and second pockets provided in said peaked cap, in that said first and second pockets are provided with closure means, thereby enabling said accessory fittings to be rapidly replaced into said housing pockets, when they are not in use.

According to this Utility Model, said protective element for neck and ears is formed by mutual coupling of a set of segments attached to said peaked cap along its perimetral edge, said segments being attached to one another only along a portion of their longitudinal dimension, thereby enabling the air to more freely pass therethrough.

According to an alternative embodiment, said element for protection of neck and ears consists of a single segment and is provided with a slot corresponding to the ears, said slot being provided with a protective material so as to prevent the dust from passing therethrough.

A further suggestion according to this Utility Model is to provide said face protection element with a front pocket, corresponding to nose and mouth, designed for containment of a filter material.

Also according to this Utility Design, said pocket designed for housing said protective element for neck and ears is provided within the inner portion of said cap, in a position corresponding to the edge thereof.

Alternatively, said protective element for neck and ears can be housed in a pocket provided in the external portion of said peaked cap.

A further suggestion according to this Utility Design consists in housing said face protection element in a pocket provided within the cap.

Also according to this Utility Design, it is suggested that the peaked cap be provided with pads having pressure fastening means for attaching glasses thereto.

Furthermore, it is proposed to make said peaked cap, said protective elements for neck and ears, as well as said protective element for the face with a flame resistant and hydrorepellant material.

In a preferred embodiment of this Utility Design, said segment type protective element for neck and ears has a resilient connection member, designed to keep the segments in closed position, even under the action of the wind.

This Utility Design is described by way of illustration and not by way of limitation, with reference to the attached drawings, wherein.

Figure 3:
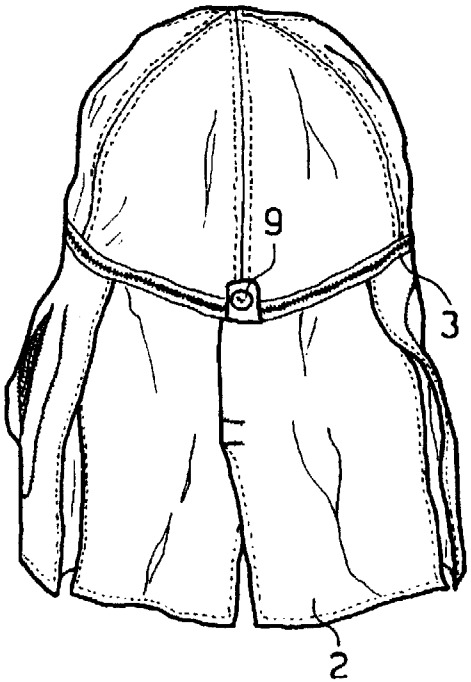
FIG. 3 shows a rear view of the cap of FIG. 1.
Figure 2:
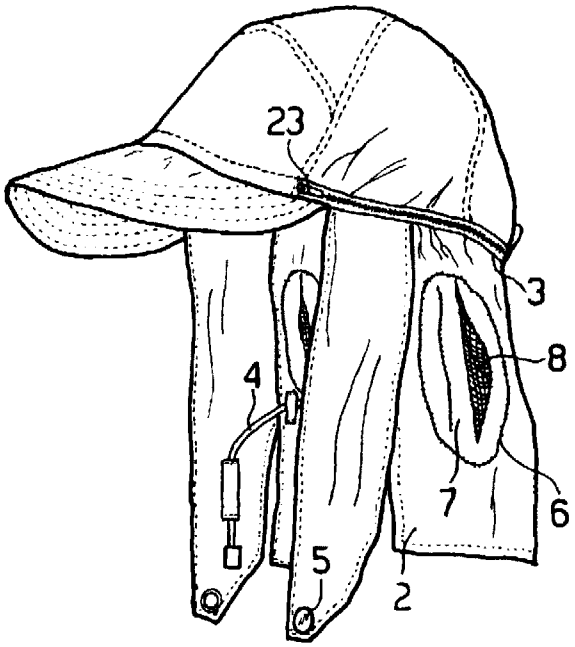
FIG. 2 shows a perspective view of the cap of FIG. 1.
Figure 1:
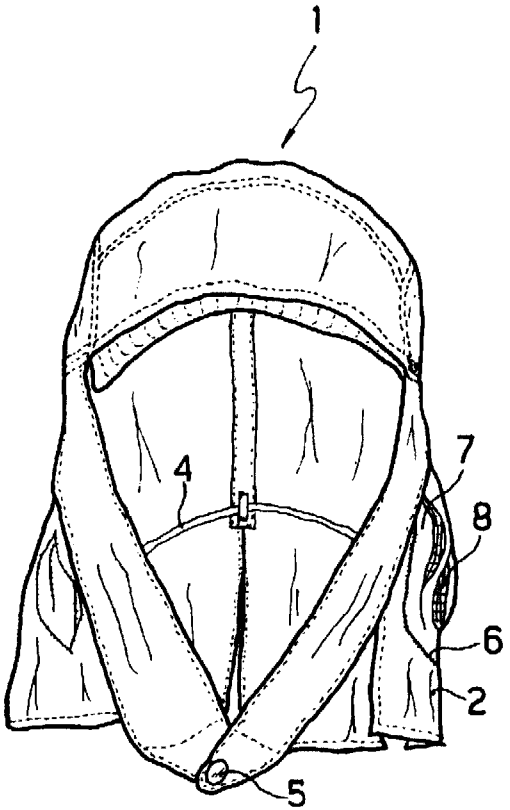
FIG. 1 shows a front view of a first embodiment of a peaked cap provided with accessory fittings for protection of neck, ears, throat.

As it can be observed in FIGS. 1, 2, 3, the concerned cap 1, preferably of helmet type having a front peak to enable a better protection of the head and of the face to be obtained, is provided with an integral element 2 for protection of the head, attached to the peaked cap 1 along edge 3 and consisting of a set of side-to-side arranged segments, connected to one another by means of a partial seam designed so as to enable such segments to protect the neck and the nape of the neck areas and in the same time to aid air to flow theretrough and to ventilate said areas of the body.

As it can be observed in FIGS. 1 and 2, said segments are made as bands and the bands are provided with an internal resilient through element 4, acting as a connection member for the various portions, thereby permitting said segments/bands to move under action of the wind, when it is not stretched.

At the ends of the two front bands, a closure element 5 is provided, preferably of button type, in order to enable the bands to be fixed under the throat.

Furthermore, the bands covering the ears are provided with a loop-shaped, preferably oval seam, within which the fabric is slitted in order to define separate segments 7.

A portion of protective fabric, partially visible in the Figure and designed with numeral 8, is preferably provided in the internal area defined by said loop-shaped seam 6 and is designed to protect the related ear from entry of any dust.

At the edge 3 along which the protective element 2 is connected to cap 1, a buttonhole 9 is provided in the rear section of the cap for attachment of the glasses retaining element (not shown).

When it is not in use, said segmented element 2 can be replaced into a suitable pocket provided near edge 3, said pocket being positioned at the outer side of the cap and closed by means of a zip-fastener 23.

Figure 6:
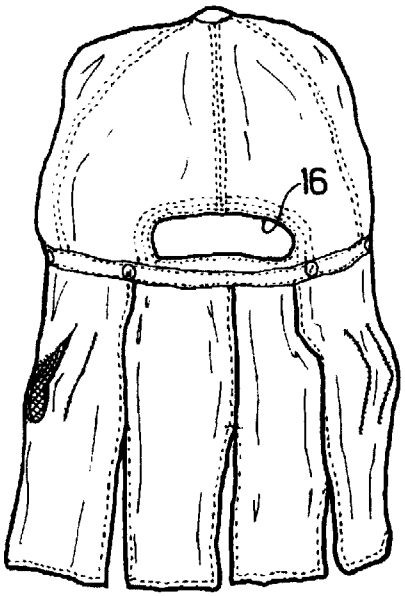
FIG. 6 shows a rear view of the cap of FIG. 4.
Figure 5:
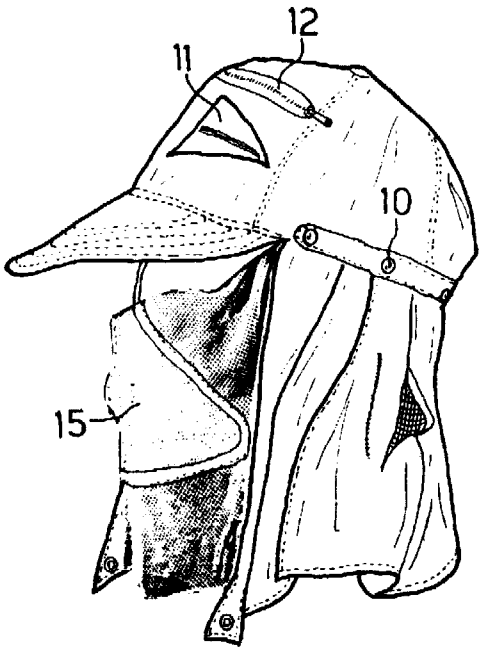
FIG. 5 shows a perspective view of the cap of FIG. 4.
Figure 4:
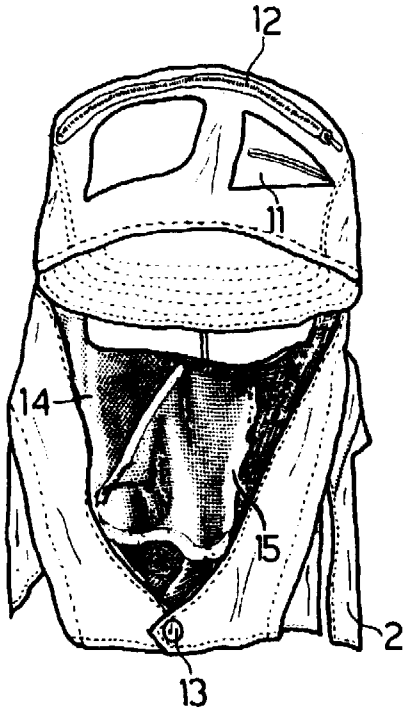
FIG. 4 shows a front view of a second embodiment of the peaked cap according to this Utility Design provided with accessory fittings for protection of neck, ears, throat and face.

A similar segmented protective element 2 is provided in the peaked cap shown in FIGS. 4, 5 and 6, wherein the edge attachment thereof is implemented by means of pressure fastening members 10, which are formed so as to enable the protective element itself to be totally removed as a whole.

Said protective element, when it is not in use, can be replaced into a suitable pocket 11 provided on the front portion of the cap and closed by means of a zip-fastener 12 or similar closure element.

Furthermore, the two front segments are provided with a snap button closure element 13 for fixing said segments in operative position and to protect the throat.

If the face is desired to be protected, a protective element 14 is provided, made of gauze or similar material, having suitable ports corresponding to the eyes.

Said element 14 is additionally provided, in a position corresponding to the nose of the user, with a reinforced portion 15 consisting of a further superposed layer of protective material and the possibility exists to insert a particular material, such as cotton or like, between said superposed layer of protective material and said element 14, as a protection from the dust.

As it can be observed in FIG. 6, a hole 16 is provided in the rear portion of the cap, in order to enable the hair of the user to be passed therethrough.

Figure 9:
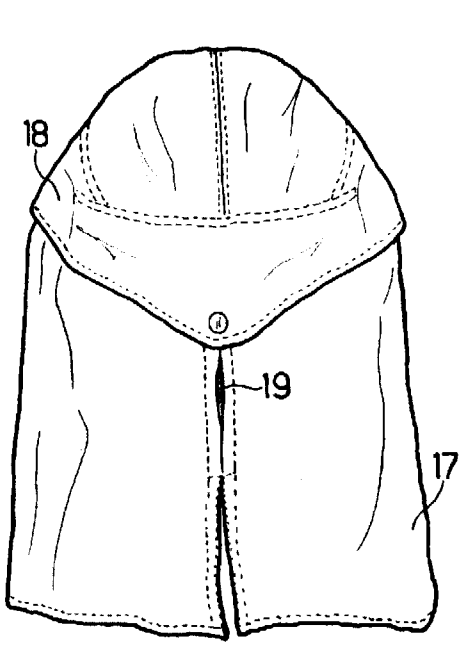
FIG. 9 shows a rear view of the cap of FIG. 7.
Figure 8:
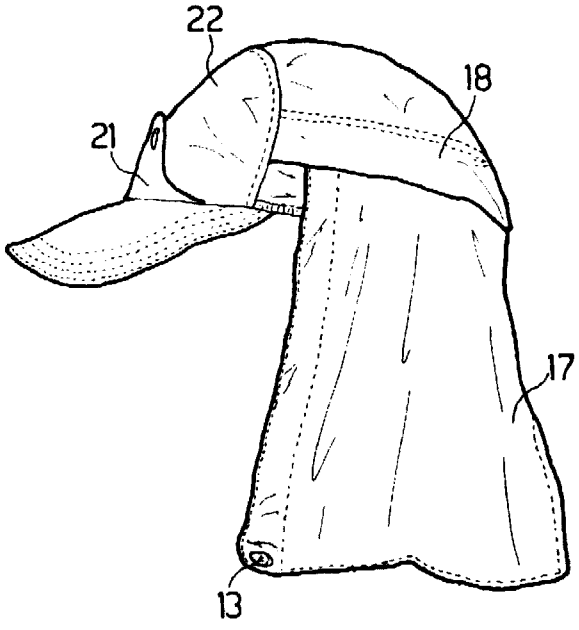
FIG. 8 shows a side view of the cap of FIG. 7.
Figure 7:
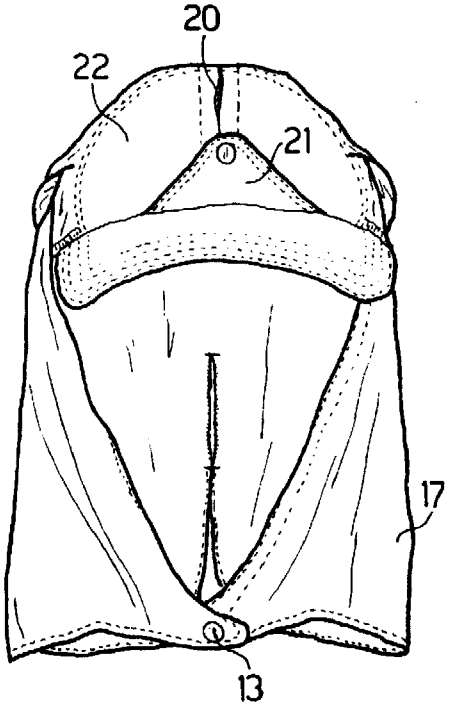
FIG. 7 shows a front view of a third embodiment of the peaked cap according to this Utility Design provided with accessory fittings for protection of neck and ears.

A further embodiment of a peaked cap 1 is shown in FIGS. 7, 8 and 9, wherein the cap is provided with a protective element 17 for neck, ears and throat of solid rather than segmented construction, having a pressure closure element 13 in front position.

Said protective element 17 can be replaced into a continuous pocket provided on the external side of the cap and covered by a closure flap 18.

As it can be observed from FIG. 9, protective element 17 is provided with a ventilation slit 19 which is internally covered by a layer of protective fabric (not shown) to prevent entry of dust.

A further slit 20 is provided in the front portion of the concerned cap 1, partially covered by the flap intended to fastening the glasses 21.

In a preferred embodiment of the cap as shown in FIGS. 7, 8 and 9, the manufacturing material used is a light waterproof material, while the pocket designed for replacement of protective element 17 can be made of a rigid leather.

Also in a preferred embodiment, the front portion 22 is made of rigid material, such as leather, in order to be used in regions with very warm climate, thereby enabling a more efficient ventilation.

According to this Utility Design application, it is suggested that the peaked caps as shown in FIGS. 1–9 be provided with a circumference adjustment arrangement, so as to enable the concerned caps to be more easily adapted to different dimensions of the user heads.

Furthermore, according to this Utility Design application, it is suggested that the peaked caps be made of flame resistant, hydrorepellant and anti-dust materials and the face protection element be made of flame resistant and hydrorepellant materials, such as a gauze or similar transparent material.

This Utility Design has been hereinbefore described, by way of illustration and not by way of limitation, according to its preferred embodiments, but it should be understood that variation and/or changes can be made by those skilled in the art without departing from the scope of this Utility Design.

I claim:

1. An integral peaked cap provided with accessory fittings for the protection of a wearer's neck and ears, replaceable into the cap itself, the cap comprising an outer side, a perimetral edge and an integral accessory fitting for protection of a wearer's neck and ears, provided with closure means in a position corresponding to the throat of a wearer, said accessory fitting being housed in a pocket provided in said peaked cap and positioned at the outer side of the cap, said pocket being provided with closure means.

2. An integral peaked cap provided with an accessory fitting for the protection of a wearer's neck and ears, replaceable into the cap itself according to claim 1, said integral accessory fitting for neck and ears comprising a set of mutually coupled segments attached to said peaked cap along its perimetral edge, said segments being attached to one another only along a portion of their longitudinal dimension.

3. An integral peaked cap provided with an accessory fitting for the protection of a wearer's neck and ears, replaceable into the cap itself according to claim 1, wherein said integral accessory fitting for a wearer's neck and ears is a single piece and is provided with a slot corresponding to a wearer's ears, said slot being provided with a protective material so as to prevent dust from passing therethrough.

4. An integral peaked cap provided with an accessory firing for the protection of a wearer's neck and ears, replaceable into the cap itself according to claim 1, wherein said pocket designed for housing said integral accessory fitting for a wearer's neck and ears and positioned at the outer side of the cap is in a position corresponding to the perimetral edge thereof.

5. An integral peaked cap provided with an accessory fitting for the protection of a wearer's neck and ears, replaceable into the cap itself according to claim 1, said peaked cap and said integral accessory fitting for a wearer's neck and ears being made of flame resistant and hydrorepellant material.

* * * * *